US007510610B2

(12) United States Patent
Kougami et al.

(10) Patent No.: US 7,510,610 B2
(45) Date of Patent: Mar. 31, 2009

(54) IMAGE RECORDING SHEET MOISTENING DEVICE AND IMAGE PRINTING APPARATUS

(75) Inventors: Masashi Kougami, Tokyo (JP); Hisao Satoh, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 404 days.

(21) Appl. No.: 11/260,086

(22) Filed: Oct. 28, 2005

(65) Prior Publication Data

US 2006/0133876 A1 Jun. 22, 2006

(30) Foreign Application Priority Data

Dec. 16, 2004 (JP) ..... 2004-364234

(51) Int. Cl.
*B05C 1/08* (2006.01)
*B05C 11/00* (2006.01)
*B41L 11/08* (2006.01)

(52) U.S. Cl. ..... 118/264; 118/261; 101/132.5

(58) Field of Classification Search ..... 399/406, 399/407, 341, 390; 118/24, 264, 261
See application file for complete search history.

(56) References Cited

U.S. PATENT DOCUMENTS 2,594,179 A * 4/1952 Keil ..... 101/132.5
5,241,355 A * 8/1993 Yamashita et al. ..... 399/407
5,264,899 A * 11/1993 Mandel ..... 399/341
5,797,318 A 8/1998 Taylor et al.

FOREIGN PATENT DOCUMENTS

| | | |
|---|---|---|
| JP | 57064261 | 4/1982 |
| JP | 4-46450 | 4/1992 |
| JP | 11-194684 | 7/1999 |
| JP | 2000-035725 | 2/2000 |
| JP | 2000-185839 | 4/2000 |
| JP | 2004 054163 | 2/2004 |

OTHER PUBLICATIONS

Machine translation of JP Pub. 2004-054163.*
Japanese Industrial Standard JIS K 7312: 1996, "Physical testing methods for molded products of thermosetting polyurethane elastomers", (13 pages).
Office Action from Japanese Patent Office dated May 27, 2008, 2 pages.
Excerpt English translation of the Office Action from Japanese Patent Office dated May 27, 2008, 1 page.

* cited by examiner

*Primary Examiner*—Daniel J. Colilla
*Assistant Examiner*—Allister Primo
(74) *Attorney, Agent, or Firm*—Finnegan, Henderson, Farabow, Garrett & Dunner, L.L.P.

(57) ABSTRACT

A sheet moistening device comprises a pair of moistening rollers which respectively have porous layers and form a nip to convey a sheet, and a dampening mechanism which supplies water to at least one of the pair of moistening rollers through a surface thereof. In the sheet moistening device, a roller surface hardness differs between the pair of moistening rollers. In addition, the sheet moistening device can further comprise a regulating device which regulates an amount of water to be supplied from the dampening mechanism to the moistening roller.

2 Claims, 10 Drawing Sheets

IMAGE RECORDING SHEET MOISTENING DEVICE AND IMAGE PRINTING APPARATUS

This application is based on and claims the priority under 35 U.S.C. § 119 from the Japanese Patent Application No. 2004-364234 filed in Japan on Dec. 16, 2004, the entire content of which is incorporated herein by reference.

BACKGROUND OF THE INVENTION

1. Field of the Invention

The present invention relates to a moistening device which moistens an image recording sheet (to be referred to as a sheet hereinafter) and an electrophotographic image printing apparatus which includes the moistening device and, more particularly, to a moistening technique of supplying moisture to a sheet to which an image has been fixed by a thermal fixing device.

2. Description of the Prior Art

In an image printing apparatus which prints an image by electrophotography, generally, a toner image is formed on a sheet with a fine toner powder. The toner image is fixed on the sheet by heating and pressurizing processes.

During the heating process in a fixing step, moisture evaporates from the sheet. As the sheet is exposed to the atmosphere, the sheet absorbs moisture, and the moisture to be contained in the sheet is recovered gradually. Moisture recovery is not uniform, however, and progresses with different proportions at different portions of the sheet. For example, when a plurality of sheets are left in a bundled state, moisture absorption of the sheets progresses fast in the peripheral portion of the sheet, but is slow or does not occur at the central portion of the sheet.

Due to a difference in moisture content, the elongation of the sheet differs depending on the location to cause a waving phenomenon on the sheet where an image has been printed.

The waving phenomenon occurs often in sheets which are printed and deposited on a delivery tray or in sheets deposited on a binding stacker, and is conspicuous particularly in sheets which are deposited in a large amount on a delivery tray including a large-volume stacker. Also, sometimes a sheet curls to form a curl.

According to a sheet moisture replacement system proposed in U.S. Pat. No. 5,264,899 (patent reference 1), a porous moistening roller is used to convey a sheet. Water is supplied to the moistening roller from its shaft core to moisten the sheet, thus preventing waving or the like of the sheet.

In this manner, deformation of a sheet after image printing includes waving deformation caused by a waving phenomenon which occurs because the elongation of the sheet differs depending on the location and deformation caused by a curling phenomenon which occurs as the sheet curls in the convey direction.

The waving phenomenon can be solved by supplying moisture to the sheet so that the entire surface of the sheet is moistened substantially uniformly. The curling phenomenon can be solved by making the moisture difference of obverse and reverse surfaces of the sheet small.

In a moistening device, a dampening mechanism damps one of two moistening rollers. The moistening roller which has been damped dampens the other moistening roller. A nip portion formed by the two moistening rollers moistens the sheet. With this moistening device, the moistening roller which is directly damped by the dampening mechanism dampens the sheet with a larger amount of water than in damping from the other moistening roller to the sheet. Therefore, the moisture difference of obverse and reverse surfaces of the sheet becomes large, and the curl phenomenon is easy to come to occur.

SUMMARY OF THE INVENTION

The present invention has been made in view of the above situation, and has as its object to provide a moistening device which does not cause a waving phenomenon or curling phenomenon, and an image printing apparatus which includes this moistening device.

According to one main practical aspect of the present invention, there is provided a sheet moistening device comprising a pair of moistening rollers which respectively have porous layers and form a nip to convey a sheet, and a dampening mechanism which supplies water to at least one of the pair of moistening rollers through a surface thereof, wherein a roller surface hardness differs between the pair of moistening rollers which form the nip.

The sheet moistening device according to the above aspect can further comprise a regulating device which regulates an amount of water to be supplied to the moistening roller.

According to another main practical aspect of the present invention, there is provided an image printing apparatus comprising an image printing unit which transfers a toner image to a predetermined position on a sheet to form an image, a fixing device which heats and pressurizes the sheet on which the image has been transferred to fix the image, and a moistening device according to the above first example which moistens the sheet on which the image has been fixed by the fixing device.

BRIEF DESCRIPTION OF THE DRAWINGS

Embodiments of the present invention will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

The several preferred embodiments of the present invention will be described in detail with reference to the accompanying drawings.

Figure 1:
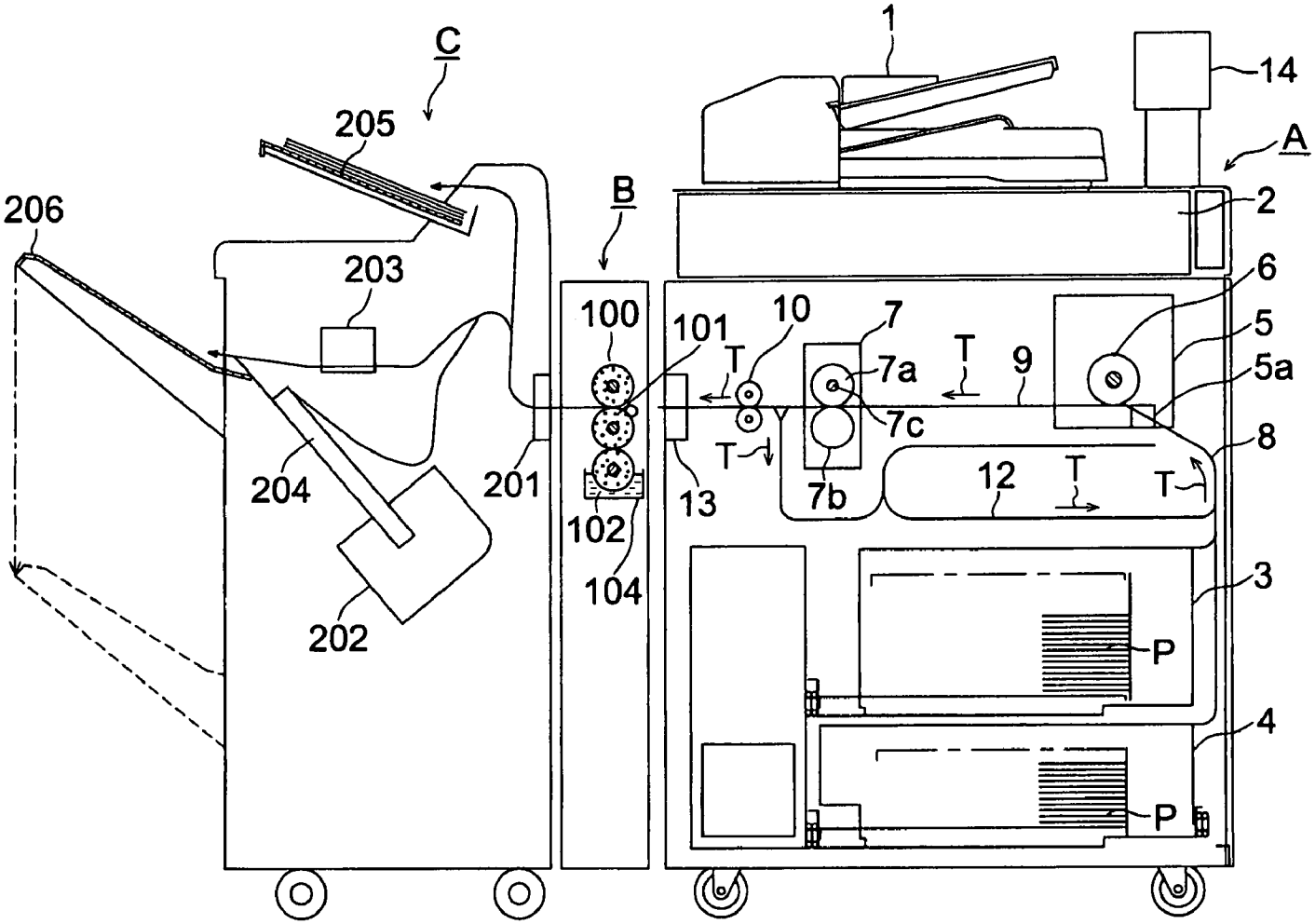
FIG. 1 is a schematic overall sectional view showing an image printing apparatus according to an embodiment of the present invention.

FIG. 1 is a schematic overall sectional view of an image printing apparatus according to an embodiment of the present invention. The image printing apparatus includes an image printing apparatus main body A, moistening device B, and post-processing device C.

The image printing apparatus main body A has an automatic document feeder 1 and image reader 2 in its upper portion, and its lower portion includes a printer unit and sheet storages 3 and 4 for storing sheets P.

The printer unit has an image printing unit 5. The image printing unit 5 has a photosensitive drum 6 and prints a toner image on the photosensitive drum 6 by an electrophotographic process of charging, exposure, and development. In the image printing unit 5, an image is printed on the sheet P, and the printed image is fixed by a fixing device 7. In the fixing device 7, a heat roller 7*a* incorporating a heat source 7*c* and a pressure roller 7*b* form a nip to convey the sheet P. While conveying the sheet P, the fixing device 7 heats and pressurizes the sheet P to melt the toner, thus printing the image on the sheet P.

The sheet P is supplied from the sheet storage 3 or 4 and temporarily stopped at a feeding portion 5*a* of the image printing unit 5. Then, the sheet P is fed from the feeding portion 5*a* of the image printing unit 5 to print the image. The image-printed sheet P is delivered by delivery rollers 10 through a delivery port 13.

A sheet convey path includes a sheet feed path 8 extending from the sheet storages 3 and 4 to the image printing unit 5, a convey path 9 extending from the image printing unit 5 to the delivery port 13 through the fixing device 7 and delivery rollers 10, and a reverse surface convey path 12 which reverses and conveys the sheet P. In FIG. 1, an arrow indicated by reference symbol T denotes the sheet convey direction.

The image printing mode includes single-face-down delivery mode, single-face-up delivery mode, and double-sided mode. In the single-face-down delivery mode, a sheet P which has been printed on its one surface and passed through the fixing device 7 is converted upside down by a converting process and delivered as it is conveyed by the delivery rollers 10.

In the single-face-up delivery mode, a sheet P which has been printed on its one surface and conveyed along the convey path 9 is directly delivered as it is conveyed by the delivery rollers 10.

In the double-sided mode, a sheet P which has been printed on its one surface and passed through the fixing device 7 travels downward to advance to the reverse surface convey path 12. The sheet P is reversed and fed to the sheet feed path 8 again.

The image printing unit 5 forms a reverse image on the reverse surface of the sheet P which is fed to the sheet feed path 8 again. The sheet P which is printed on its reverse surface passes through the fixing device 7 and is delivered as it is conveyed by the delivery rollers 10.

Reference numeral 14 denotes an operation unit. Various types of modes of the image printing apparatus main body A and an output mode using the post-processing device C can be set by operating the operation unit 14.

The sheet P which is delivered from the image printing apparatus main body A through the delivery port 13 is conveyed to the post-processing device C through the moistening device B. The moistening device B will be described later.

The post-processing device C has a staple process unit 202, shift process unit 203, and intermediate stacker 204. The post-processing device C performs a staple process or shift process to the sheet P, and delivers the processed sheet P to an elevating delivery tray 206.

The post-processing device C further has a stationary deliver tray 205. In a small-amount image printing job, a sheet P introduced from an introduction port 201 is delivered onto the stationary deliver tray 205.

In the staple process, a preset number of sheets are piled on the intermediate stacker 204 and subjected to the staple process by the staple process unit 202. The bundle of processed sheets P moves upward along the intermediate stacker 204 and is delivered onto the elevating delivery tray 206.

Even in a mode in which a post-process such as the staple process or shift process is not performed, if a large amount of images are to be printed, the sheets P are delivered onto the elevating delivery tray 206.

The moistening device B has a pair of moistening rollers which respectively have porous layers and form a nip to convey the sheet P, and a dampening mechanism which supplies water to one moistening roller through its surface. The roller surface hardness differs between the two moistening rollers. The moistening roller having a harder surface serves as a moistening roller to which water is supplied from the dampening mechanism.

Figure 2:
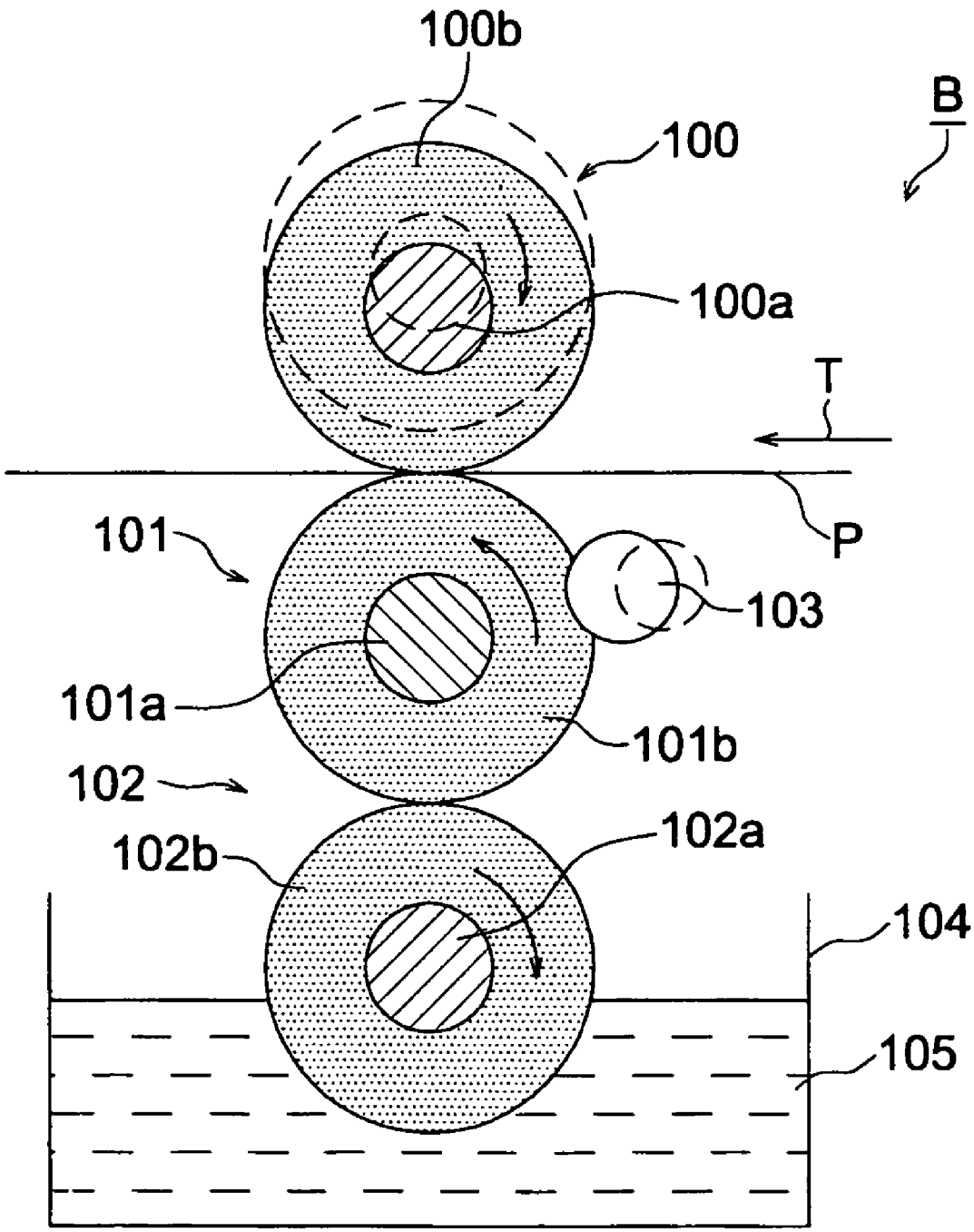
FIG. 2 is a schematic sectional view showing a moistening device according to the first embodiment of the present invention.

FIG. 2 is a schematic sectional view showing the moistening device B according to the first embodiment of the present invention.

Referring to FIG. 2, reference numerals 100 and 101 denote moistening rollers which supply moisture to the sheet. The moistening rollers 100 and 101 are respectively obtained by forming porous layers 100*b* and 101*b* formed of porous urethane rubber or the like on shaft cores 100*a* and 101*b* made of rigid bodies such as a metal, hard resin, or the like. Both the porous layers 100*b* and 101*b* form porous surface layers which receive supplied water through their surfaces and supply moisture to the sheet P to moisten it. Reference numeral 102 denotes a dampening roller serving as a dampening mechanism which comes into contact with the lower moistening roller 101 to supply water to it. The dampening roller 102 preferably comprises a roller including a shaft core 102*a* which is made of a rigid body such as a metal or hard resin and a porous layer 102*b* which is formed on the shaft core 102*a* and made of porous urethane rubber or the like.

As the dampening roller 102, one which has no shaft core 102*a* and forms a roller or pad made of only a porous material can be used. The dampening roller 102 preferably has the porous layer 102*b*, as described above, to dampen the moistening roller 101 quickly when the moistening device B is started. However, a porous layer is not always necessary, and a roller made of a material, e.g., a metal or hydrophilic resin, or solid rubber, which has a hydrophilic surface that does not absorb water but can retain water in its surface can be used. The moistening rollers 100 and 101 and dampening roller 102 are driven by motors (not shown) to rotate as shown in arrows so as to convey the sheet P.

Reference numeral 103 denotes a regulating member which forms a regulating device and is made of a rigid body such as a round-rod-shaped metal or hard resin. The regulating member 103 comes into tight contact with the moistening roller 101 to suppress moisture contained in the surface portion of the porous layer 101*b*, thus regulating the amount of moisture to be supplied to the sheet P. More specifically, the regulating member 103 comes into tight contact with the porous layer 101*b* of the moistening roller 101 to deform the porous layer 101*b*, thereby squeezing out water contained in the porous layer 101*b*. This regulates the amount of water to be supplied to the sheet P, so that the sheet P is moistened appropriately. When the contact pressure of the regulating member 103 with the moistening roller 101 is adjusted, appropriate moistening can be performed.

While the sheet P to be conveyed is nipped by the moistening rollers 100 and 101 and conveyed, it is moistened by water soaking from the porous layer at the nip between the moistening rollers 100 and 101. The amount of water to be supplied to the sheet P is regulated appropriately by squeezing it by the regulating member 103.

The regulating member 103 comes into tight contact with the moistening roller 101 to regulate the amount of water to be supplied. The regulating member 103 may be driven by the moistening roller 101 to rotate, or may not rotate but come into tight contact with the moistening roller 101. The pressure with which the regulating member 103 comes into tight contact with the moistening roller 101 is set appropriately. Although water supply from the dampening roller 102 to the moistening rollers is started with the lower moistening roller 101, it may be started with the upper moistening roller 100. Alternatively, water may be supplied to both, upper and lower moistening rollers 100 and 101.

When the amount of water to be supplied to the moistening rollers 100 and 101 by the regulating member 103 is regulated in this manner, the sheet P to be conveyed is moistened appropriately. If moistening is insufficient, waving of the sheet P may not be corrected sufficiently. If moistening is excessive, the sheets P piled on the delivery unit may stick to each other, or the toner that forms the image may attach to the member or sheet with which it is in contact. However, these inconveniences are prevented well.

In the first embodiment shown in FIG. 2, the moistening roller 100 can be moved to the upper position indicated by a broken line. More specifically, when the image printing apparatus is to be stopped, the moistening roller 100 is set at the position of the broken line to be separate from the moistening roller 101, so that deformation of the moistening rollers 100 and 101 can be prevented. Similarly, when the regulating member 103 is to be stopped, it can be moved to the position indicated by the broken line to be separate from the moistening roller 101. This can prevent deformation of the moistening rollers 100 and 101.

When the nip amount of the nip formed between the moistening rollers 100 and 101, that is, the length in the convey direction of the nip is changed, the amount of water to be supplied to the sheet P can be adjusted. The amount of water to be supplied to the sheet P can also be adjusted by changing the pressure of the regulating member 103.

In the moistening device B of the first embodiment, the hardness of the roller surface of the moistening roller 101 is set to be higher than that of the moistening roller 100.

Regarding the hardness (rubber hardness) of the roller surface at the porous layer portion of the moistening roller, when it is expressed by Asker-C representation based on the standard of JIS K7312 and JIS S6050, the hardness of each of the two moistening rollers 100 and 101 falls between Asker-C 5° to 60°. Preferably, the rubber hardness of the moistening roller 101 shows a value higher than that of the moistening roller 100 by 5° to 15°.

Here, as an interpretation of the Asker-C, please refer to the attached materials of JIS K 7312: 1996 where a testing method, testing equipment, etc., concerning the Asker-C are disclosed.

According to the first embodiment, the moistening device B uses a roller having a hardness of Asker-C 10° as the moistening roller 100 and a roller having a hardness of Asker-C 20° as the moistening roller 101 to moisten the sheet P conveyed from the fixing device 7. Since almost equal amounts of moistures are supplied to the obverse and reverse surfaces of the sheet that passes through the nip, both a waving phenomenon and a curling phenomenon do not occur.

Figure 3:
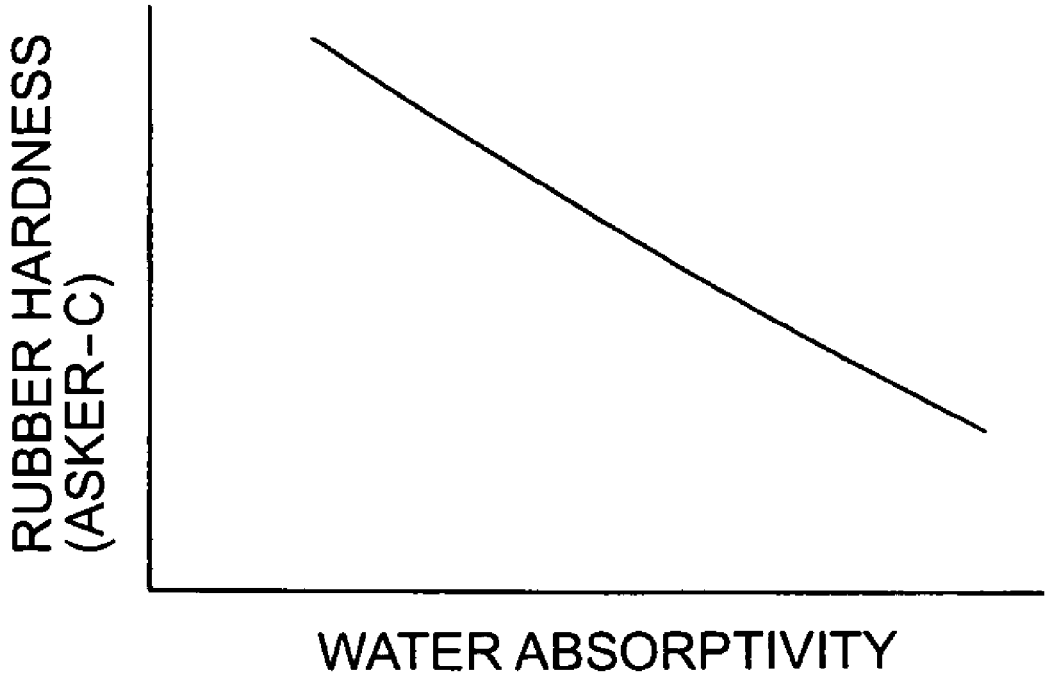
FIG. 3 is a graph showing the relationship between the hardness of rubber and water absorptivity.

FIG. 3 shows the relationship between the rubber hardness and water absorptivity of a roller having a urethane rubber layer with a pore diameter of 5 μm to 30 μm and a porosity of 50% to 95%.

FIG. 3 shows the relationship between the rubber hardness and water absorptivity. The roller having a low rubber hardness has a better water absorptivity which indicates moisture shift to the roller at the contact portion.

The above graph shows that it is appropriate to employ a roller having a high rubber hardness as the moistening roller 101 which is more advantageous in terms of moisture supply conditions than the moistening roller 100.

From the viewpoint of occurrence of the waving phenomenon, to what extent a difference in moisture content between the obverse and reverse surfaces of the sheet is allowed differs depending on the paper quality, paper thickness, and the like. The harder the paper quality, the lower the water absorptivity, and the larger the paper thickness, the larger the tolerance for a difference in moisture content.

Figure 4:
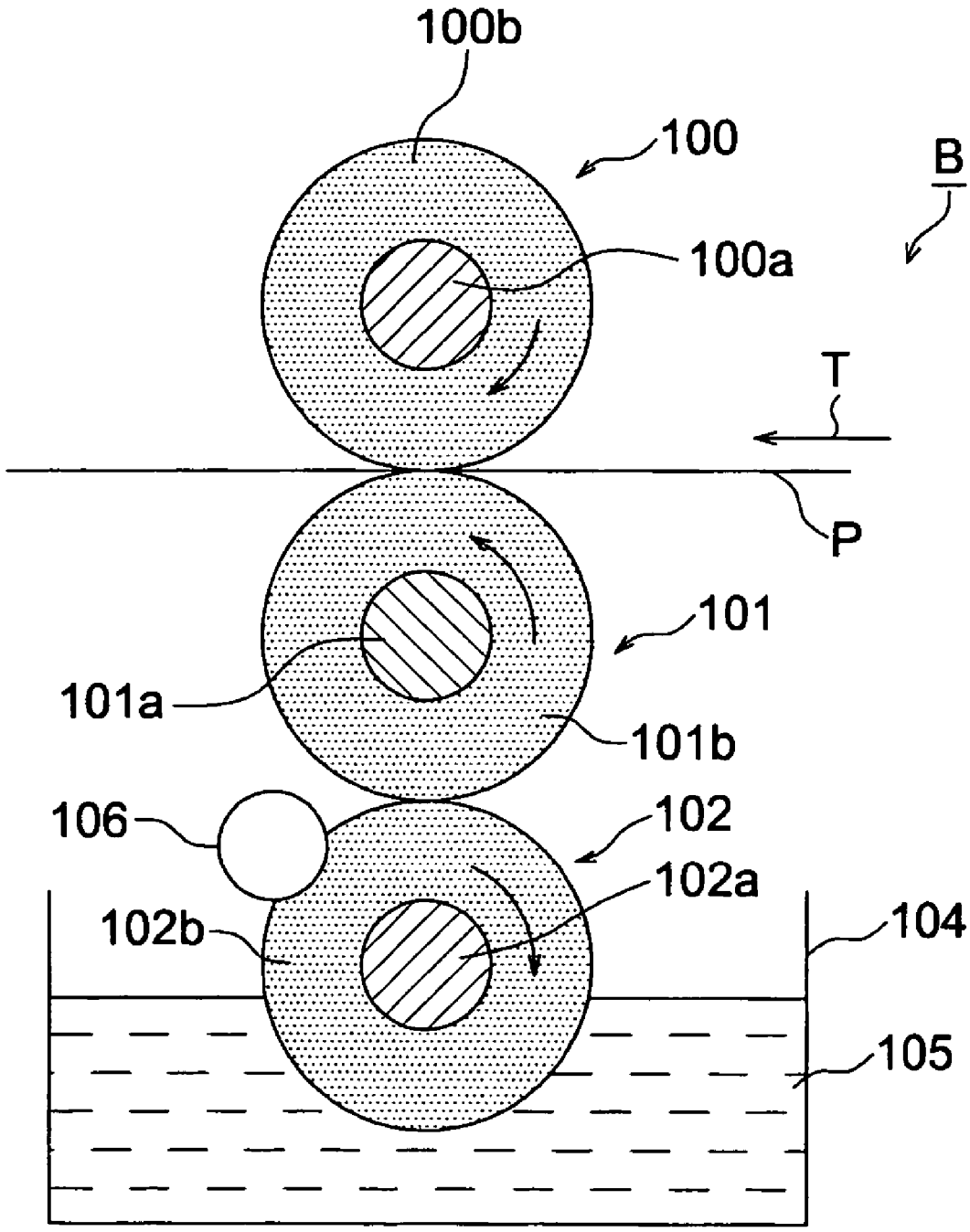
FIG. 4 is a schematic sectional view showing a moistening device according to the second embodiment of the present invention.

FIG. 4 is a schematic sectional view showing a moistening device according to the second embodiment of the present invention.

According to the second embodiment, a regulating member 106 is in tight contact with a dampening roller 102. The amount of water contained in the dampening roller 102 is regulated. Hence, the regulating member 106 is not brought into tight contact with a moistening roller 101 but with the dampening roller 102. Thus, deformation of the moistening roller 101 can be prevented.

In the second embodiment, a difference is provided in roller surface hardness between a moistening roller 100 and the moistening roller 101. As the moistening roller 101, a roller having a higher hardness than that of the moistening roller 100 is used. Thus, a sheet delivered through a nip portion is free from a curl phenomenon or waving phenomenon but is moistened uniformly.

Figure 5:
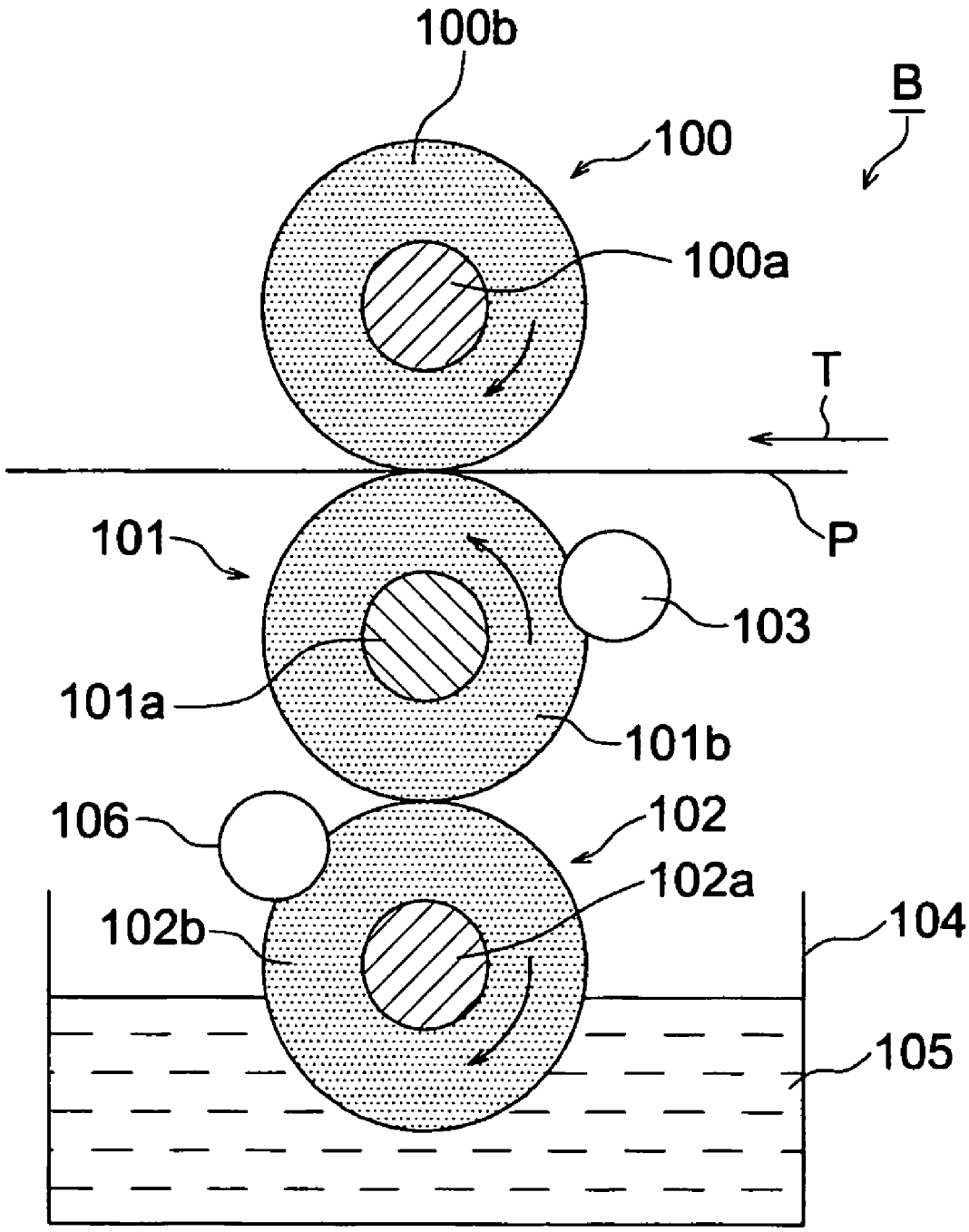
FIG. 5 is a schematic sectional view showing a moistening device according to the third embodiment of the present invention.

FIG. 5 is a schematic sectional view showing a moistening device according to the third embodiment of the present invention.

According to the third embodiment, a regulating device includes two regulating members 103 and 106. The regulating member 103 is brought into tight contact with a moistening roller 101 to regulate the amount of water contained in the moistening roller 101. The regulating member 106 is brought into tight contact with a dampening roller 102 to control the amount of water contained in the dampening roller 102. When the two regulating members 103 and 106 are used in this manner, the proportion of water to be supplied to a sheet P can be controlled more accurately, so that the sheet P can be corrected well.

In the third embodiment, a difference is provided in roller surface hardness between a moistening roller 100 and the moistening roller 101. As the moistening roller 101, a roller having a higher hardness than the moistening roller 100 is used. Thus, a sheet delivered through a nip portion is free from a curl phenomenon or waving phenomenon but is moistened uniformly.

Figure 6:
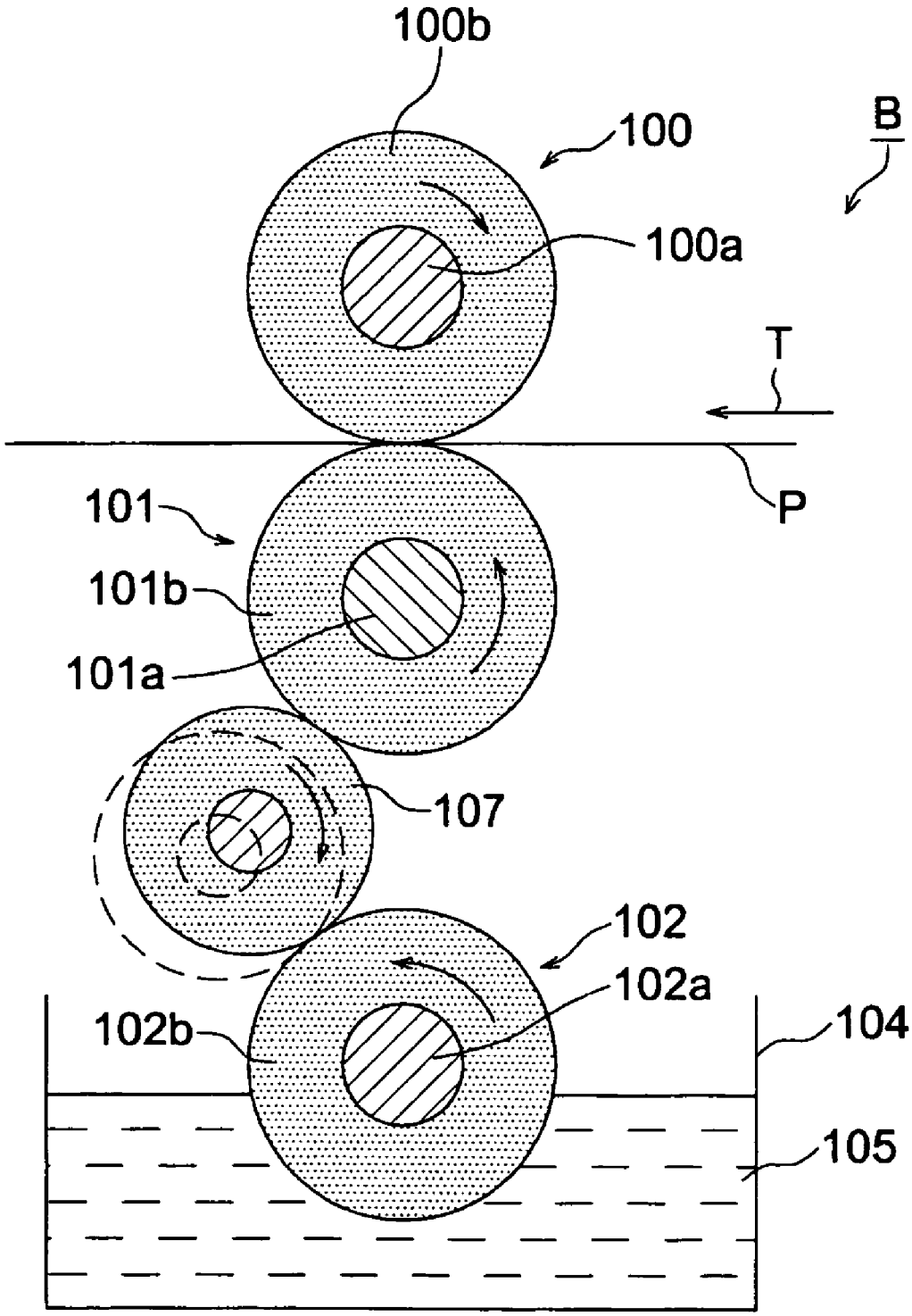
FIG. 6 is a schematic sectional view showing a moistening device according to the fourth embodiment of the present invention.

FIG. 6 is a schematic sectional view showing a moistening device according to the fourth embodiment of the present invention.

Figure 7:
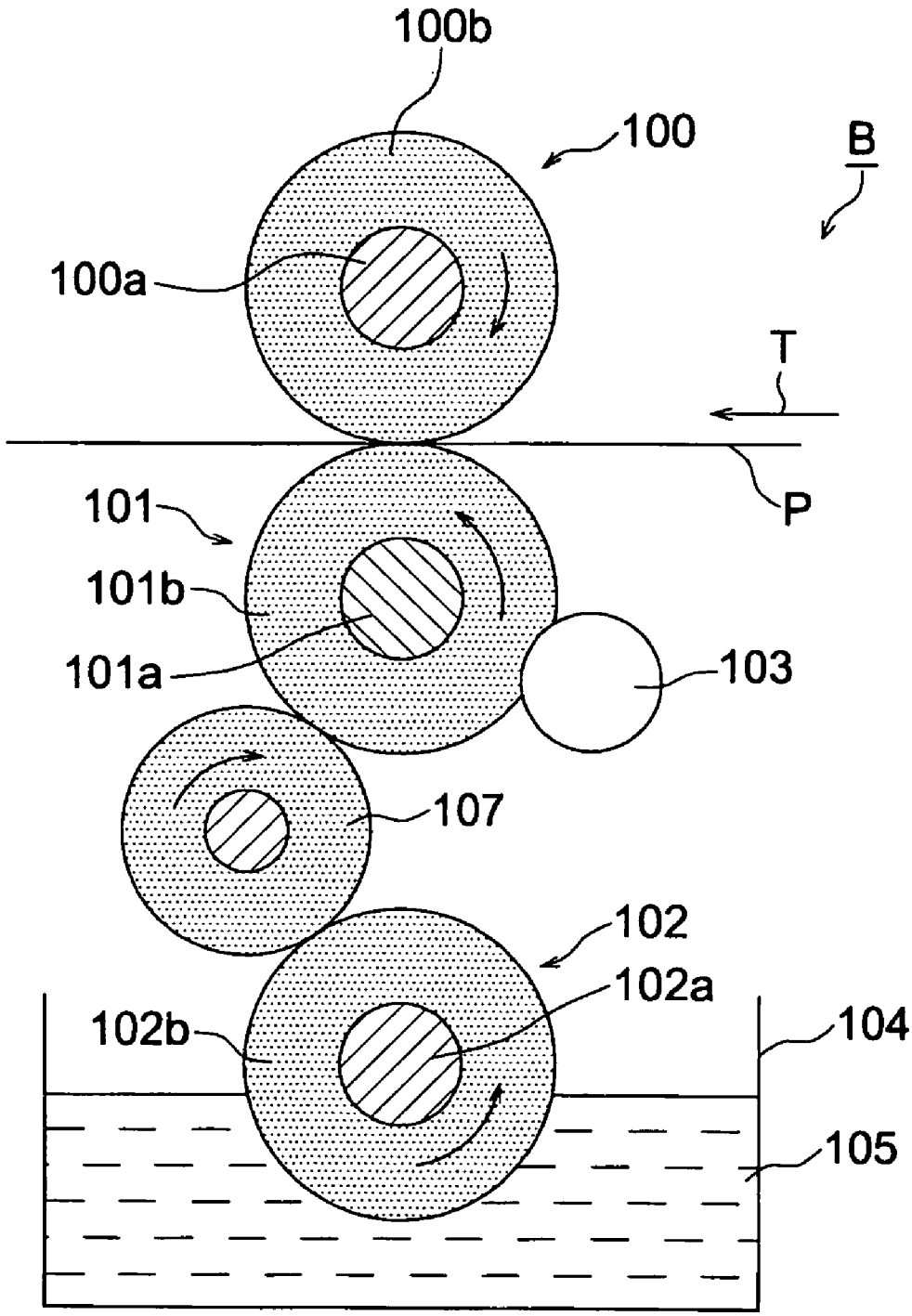
FIG. 7 is a schematic sectional view showing a moistening device according to the fifth embodiment of the present invention.

According to the fourth embodiment, a dampening mechanism includes a dampening roller 102 and relay roller 107. More specifically, the relay roller 107 is interposed between a lower moistening roller 101 and the dampening roller 102. The relay roller 107 is a member which receives water from the dampening roller 102 and supplies it to the moistening roller 101, and preferably has a porous layer. A hydrophilic non-porous roller which can retain water in its surface can also be used as the relay roller 107. As indicated by the broken line, the relay roller 107 can move to a retreat position spaced apart from the moistening roller 101. When the image printing apparatus is to be started, the relay roller 107 is set at the operative position indicated by the solid line. When the image printing apparatus is to be stopped, the relay roller 107 is retreated to the position indicated by the broken line. In the example of FIG. 7, while the relay roller 107 is in contact with the dampening roller 102, it is spaced apart from the moistening roller 101. Alternatively, while the relay roller 107 is in contact with the moistening roller 101, it may be spaced apart from the dampening roller 102, or may be displaced to a retreat position spaced apart from both the moistening roller 101 and dampening roller 102.

With the above arrangement, while the image printing apparatus is stopped and the moistening roller 101 is stopped, water is supplied to the moistening roller 101. Consequently, when the moistening roller 101 is rotated to moisten a sheet P, nonuniform dampening is prevented. When a moistening roller 100 and the moistening roller 101 are to be rotated without conveying a sheet P, water is prevented from being excessively supplied to the moistening rollers 100 and 101, and inconveniences such as excessive wetting of the moistening rollers 100 and 101 can be prevented. An arrangement is also possible in which the relay roller 107 is brought into contact with the moistening roller 100 to dampen it.

In the fourth embodiment, a difference is provided in roller surface hardness between the moistening rollers 100 and 101. As the moistening roller 101, a roller having a higher hardness than that of the moistening roller 100 is used. Thus, a sheet delivered through a nip portion is free from a curl phenomenon or waving phenomenon but is moistened uniformly.

FIG. 7 is a schematic sectional view showing a moistening device according to the fifth embodiment of the present invention.

According to the fifth embodiment, a relay roller 107 is provided between a moistening roller 101 and dampening roller 102, and a regulating member 103 is brought into tight contact with the moistening roller 101 to regulate the amount of water to be supplied to a sheet P. In the fifth embodiment, an appropriate amount of water is supplied to the sheet P, and water can be prevented from being excessively supplied to a moistening roller 100 and the moistening roller 101.

In the fifth embodiment, a difference is provided in roller surface hardness between the moistening rollers 100 and 101. As the moistening roller 101, a roller having a higher hardness than that of the moistening roller 100 is used. Thus, a sheet delivered through a nip portion is free from a curl phenomenon or waving phenomenon but is moistened uniformly.

Figure 8:
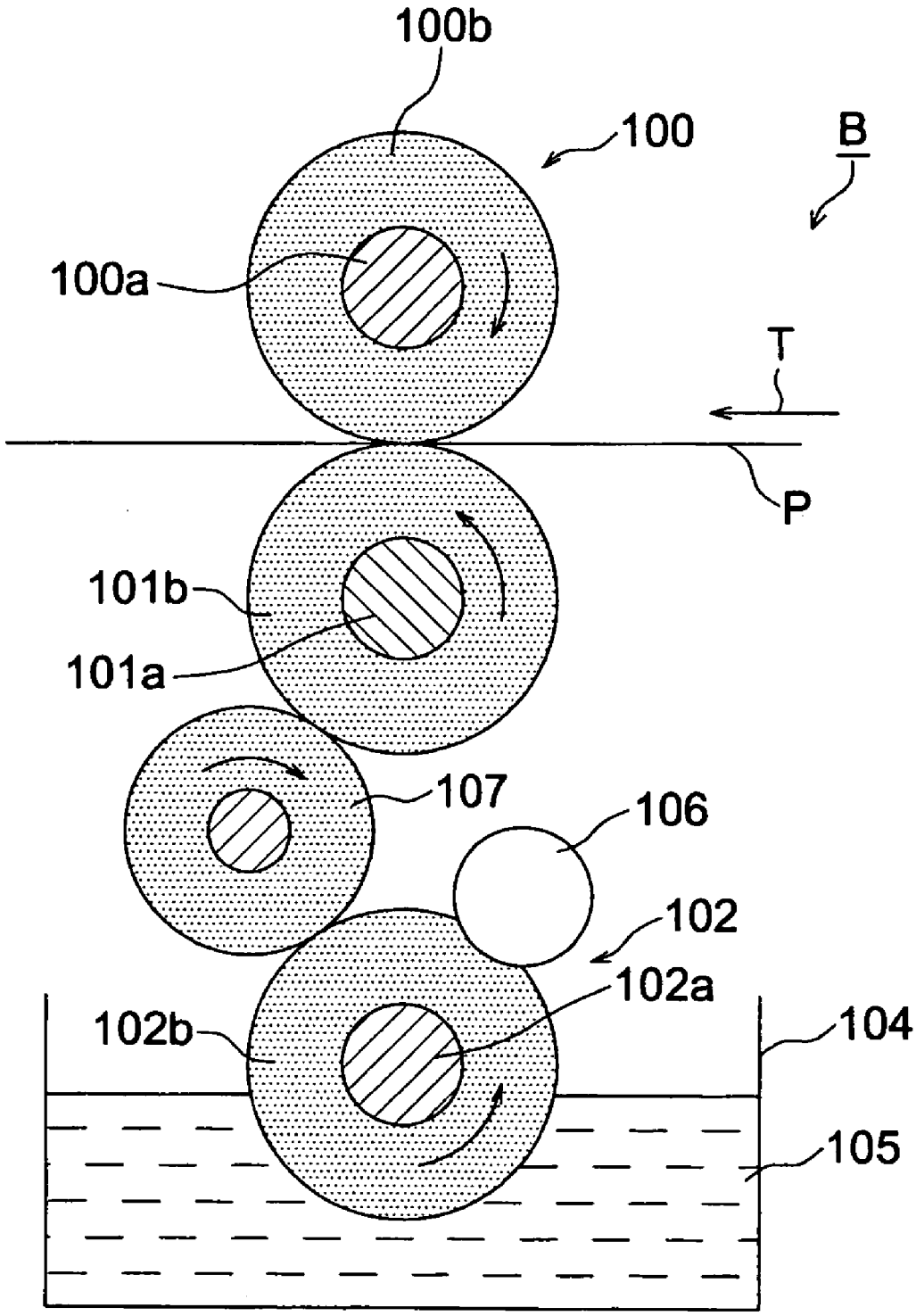
FIG. 8 is a schematic sectional view showing a moistening device according to the sixth embodiment of the present invention.

FIG. 8 is a schematic sectional view showing a moistening device according to the sixth embodiment of the present invention.

According to the sixth embodiment, a relay roller 107 is provided between a moistening roller 101 and dampening roller 102, and a regulating member 106 is brought into tight contact with the dampening roller 102 to regulate the amount of water to be supplied to a sheet P. In the sixth embodiment, an appropriate amount of water is supplied to a sheet P, and water can be prevented from being excessively supplied to a moistening roller 100 and the moistening roller 101.

In the sixth embodiment, a difference is provided in roller surface hardness between the moistening rollers 100 and 101. As the moistening roller 101, a roller having a higher hardness than that of the moistening roller 100 is used. Thus, a sheet delivered through a nip portion is free from a curl phenomenon or waving phenomenon but is moistened uniformly.

Figure 9:
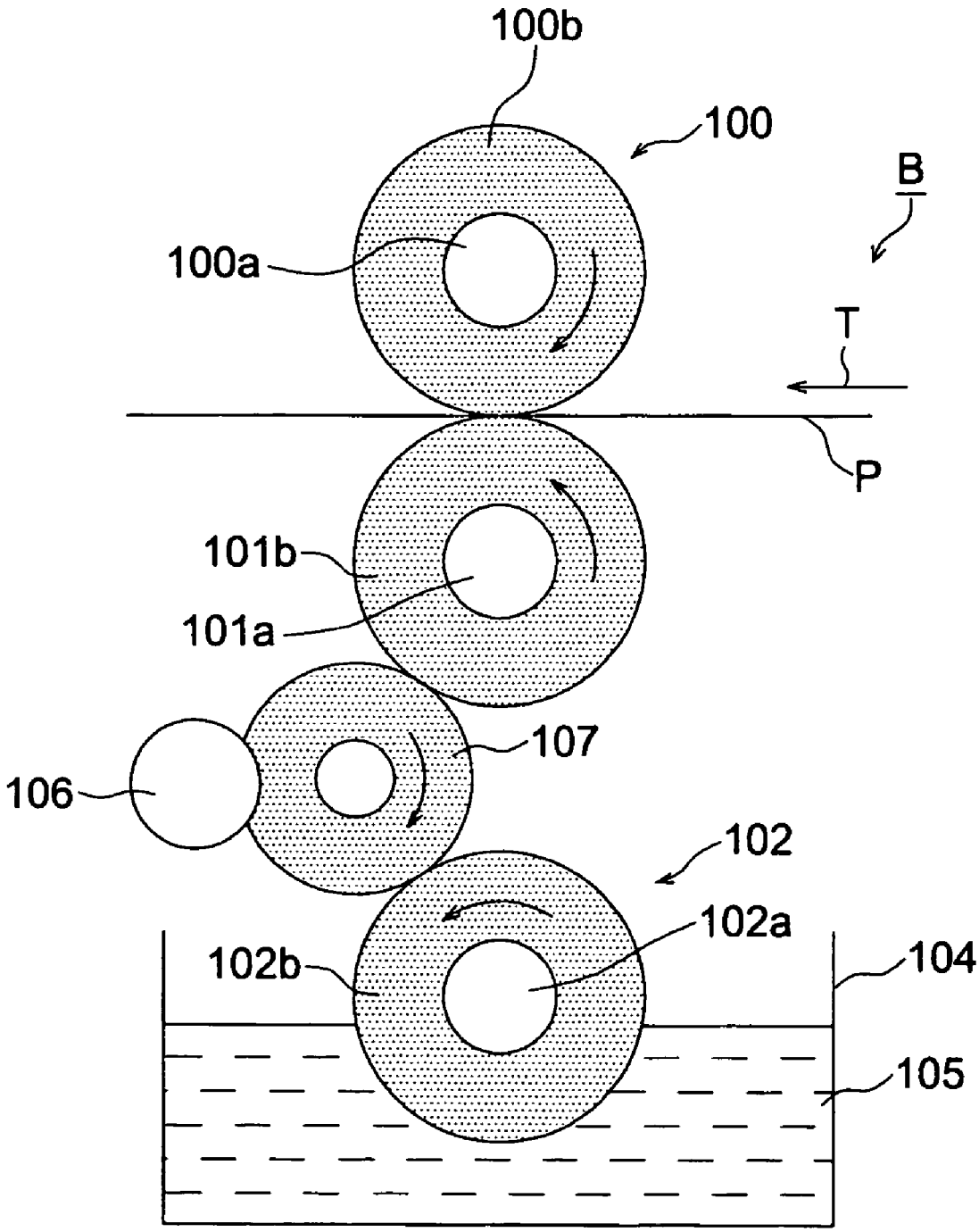
FIG. 9 is a schematic sectional view showing a moistening device according to the seventh embodiment of the present invention.

FIG. 9 is a schematic sectional view showing a moistening device according to the seventh embodiment of the present invention.

According to the seventh embodiment, a relay roller 107 is provided between a moistening roller 101 and dampening roller 102, and a regulating member 106 is brought into tight contact with the relay roller 107 to regulate the amount of water to be supplied to a sheet P. In the seventh embodiment, an appropriate amount of water is supplied to the sheet P, and water is prevented from being excessively supplied to a moistening roller 100 and the moistening roller 101.

In the seventh embodiment, a difference is provided in roller surface hardness between the moistening rollers 100 and 101. As the moistening roller 101, a roller having a higher hardness than that of the moistening roller 100 is used. Thus, a sheet delivered through a nip portion is free from a curl phenomenon or waving phenomenon but is moistened uniformly.

Figure 10:
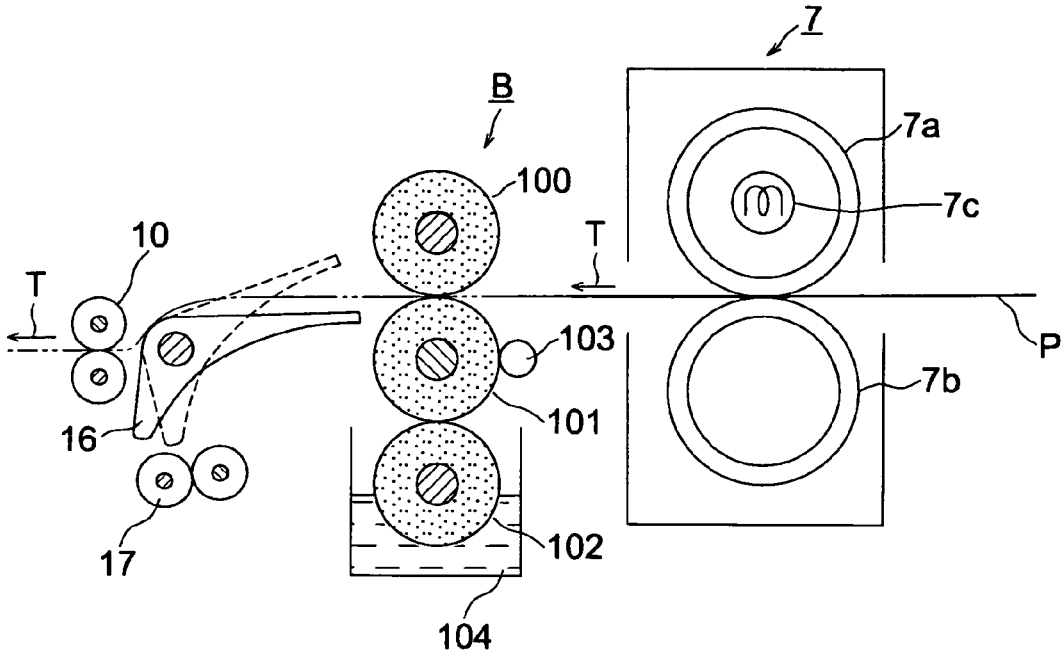
FIG. 10 is a schematic sectional view of the main part of an image printing apparatus according to another embodiment of the present invention.

One of the moistening devices described in the first to seventh embodiments can be provided downstream of the fixing device in the image printing apparatus main body and upstream of the delivery rollers 10. FIG. 10 shows the main part (delivery portion) in an image printing apparatus according to another embodiment of the present invention. According to this embodiment, a moistening device B is arranged between a fixing device 7 and switching gate 16.

When the switching gate 16 is located at the position indicated by a solid line, it guides forward a sheet P delivered from the fixing device 7 to delivery rollers 10. When the switching gate 16 is located at the position indicated by a broken line, it guides the sheet P downward. As described above, in the single-face-down delivery mode, after the sheet P is fixed, it travels downward, is conveyed upward by converting rollers 17, and is guided forward to the delivery rollers 10 by the switching gate 16 and delivered. In the single-face-up delivery mode, the sheet P delivered from the fixing device 7 is directly guided by the switching gate 16 to the delivery rollers 10 and delivered. In the double-sided mode, the sheet P which has been printed on its obverse surface and passed through the fixing device 7 is guided by the switching gate 16 to travel downward, and is fed to an image printing unit 5 again through a reverse surface convey path 12 shown in FIG. 1. The sheet P is then printed on its reverse surface, as described above, passes through the fixing device 7 again, and is guided forward by the switching gate 16 to be delivered by the delivery rollers 10. The switching gate 16 is driven by a solenoid (not shown) to rotate to a position of the solid line and a position of the broken line, to guide the sheet P forward, to guide the sheet P downward, and to guide the sheet P conveyed from below toward the delivery rollers 10. The position indicated by the solid line is a position to guide the sheet P forward, and the position indicated by the broken line is a position to guide the sheet P downward and to guide the sheet P from below the delivery rollers 10. In order to enable the switching gate 16 located at the position indicated by the broken line to guide the sheet P downward and to guide the sheet from below to the delivery rollers 10, the switching gate 16 is constantly biased counterclockwise by a spring (not shown). When the sheet P travels downward, it opens the switching gate 16.

With this arrangement, after the sheet P having the obverse image is passed through the moistening device B to supply moisture to the sheet P, the sheet P is supplied again to print an image on the reverse surface, so that obverse and reverse images having equal qualities are printed.

The embodiments of the present invention described above exhibits the following effects.

According to the embodiments, a difference is provided in roller surface hardness between the moistening rollers that form the nip, to make the water absorptivity and water retaining rate different between the two moistening rollers. Thus, nonuniform moistening to the obverse and reverse surfaces of the sheet which is caused due to the structure of the apparatus can be solved by making the moistening roller surfaces to have different hardnesses, so that almost similar moistening can be performed on the obverse and reverse surfaces of the sheet. Therefore, the waving and curling phenomenon of the sheet can be suppressed.

According to the embodiments, when compared to the moistening roller which is dampened by the dampening mechanism, the moistening roller which is dampened by the moistening roller uses a porous roller which has a lower surface hardness, a higher moisture content, and an excellent water absorptivity. Therefore, the moistening roller which is directly dampened by the dampening mechanism sufficiently dampens the other moistening roller with which it is in contact through the nip portion. The moistening roller containing a large amount of water and the moistening roller which is dampened by the dampening mechanism moisten the obverse and reverse surfaces of the sheet to almost similar stable states, thus eliminating the waving and curling phenomenon.

According to the embodiments, the obverse and reverse surfaces of the sheet are respectively moistened appropriately, thus further suppressing deformation such as waving.

According to the embodiments, since the regulating device is provided, water is prevented from being excessively supplied to the pair of moistening rollers. Thus, inconveniences caused by excessive water supply are prevented.

According to the embodiments, since the dampening roller is used as the dampening mechanism, water is supplied from the surface of the moistening roller. Thus, moisture is uniformly supplied to a passing sheet more reliably.

According to the embodiments, since the moistening device is provided at the stage after the fixing device, the sheet is delivered from the image printing apparatus to have no deformation such as waving or curling.

According to the embodiments, since the sheet is loaded in a flat state into the post-processing device, good post-processing without jamming or the like is performed.

What is claimed is:

1. A sheet moistening device comprising:

a pair of moistening rollers which respectively have porous layers and form a nip to convey a sheet;

a dampening mechanism which supplies water to at least one of said pair of moistening rollers through a surface whereof;

a regulating device which regulates an amount of water to be supplied from said dampening mechanism to said moistening roller, wherein a roller surface hardness differs between said pair of moistening rollers which form said nip, and one of said pair of moistening rollers which has a harder roller surface comprises a moistening roller which is dampened by said dampening mechanism;

wherein said dampening mechanism includes a dampening roller which has a porous layer and comes into contact with at least one of said moistening rollers and rotates to supply water thereto; and wherein said regulating device includes a first regulating member which is to be brought into tight contact with said moistening roller which is dampened by said dampening mechanism, and a second regulating member which is to be brought into tight contact with said dampening roller.

2. A sheet moistening device comprising:

a pair of moistening rollers which respectively have porous layers and form a nip to convey a sheet;

a dampening mechanism which supplies water to at least one of said pair of moistening rollers through a surface whereof;

a regulating device which regulates an amount of water to be supplied from said dampening mechanism to said moistening roller, wherein a roller surface hardness differs between said pair of moistening rollers which form said nip, and one of said pair of moistening rollers which has a harder roller surface comprises a moistening roller which is dampened by said dampening mechanism;

wherein said dampening mechanism includes a relay roller which has a porous layer and comes into contact with at least one of said moistening rollers and rotates to supply water thereto, and a dampening roller which has a porous layer and comes into contact with said relay roller and rotates to supply water thereto; and wherein said regulating device includes a regulating member which is to be brought into tight contact with said relay roller.

* * * * *